US008020491B2

(12) United States Patent
Simon

(10) Patent No.: US 8,020,491 B2
(45) Date of Patent: Sep. 20, 2011

(54) METHOD AND APPARATUS FOR DEFENDING AGAINST AIRBORNE AMMUNITION

(75) Inventor: Alexander Simon, Kassel (DE)

(73) Assignee: Krauss-Maffei Wegmann GmbH & Co. (DE)

( * ) Notice: Subject to any disclaimer, the term of this patent is extended or adjusted under 35 U.S.C. 154(b) by 99 days.

(21) Appl. No.: 12/526,926

(22) PCT Filed: Feb. 9, 2008

(86) PCT No.: PCT/DE2008/000250

§ 371 (c)(1),
(2), (4) Date: Aug. 12, 2009

(87) PCT Pub. No.: WO2008/098562

PCT Pub. Date: Aug. 21, 2008

(65) Prior Publication Data

US 2010/0117888 A1 May 13, 2010

(30) Foreign Application Priority Data

Feb. 12, 2007 (DE) ..... 10 2007 007 403

(51) Int. Cl.
*F42C 13/00* (2006.01)

(52) U.S. Cl. ..... 102/211; 102/200; 102/221; 342/95

(58) Field of Classification Search ..... 102/200–204, 102/211; 342/95
See application file for complete search history.

(56) References Cited

U.S. PATENT DOCUMENTS

| | | | | |
|---|---|---|---|---|
| 3,670,652 | A | 6/1972 | Ziemba | |
| 4,765,244 | A * | 8/1988 | Spector et al. | 102/213 |
| 5,322,016 | A * | 6/1994 | Toth | 102/211 |
| 5,814,756 | A | 9/1998 | Boss | |
| 5,862,496 | A * | 1/1999 | Biven | 701/3 |
| 7,249,730 | B1 * | 7/2007 | Flippen, Jr. | 244/3.15 |
| 2003/0117309 | A1 | 6/2003 | Papper et al. | |
| 2004/0021033 | A1 * | 2/2004 | Redano | 244/3.1 |
| 2004/0075605 | A1 * | 4/2004 | Bradford et al. | 342/95 |
| 2006/0103569 | A1 | 5/2006 | Papper et al. | |
| 2007/0074625 | A1 | 4/2007 | Seidensticker | |
| 2007/0159379 | A1 * | 7/2007 | Bannasch et al. | 342/67 |

FOREIGN PATENT DOCUMENTS

| | | |
|---|---|---|
| DE | 4426014 | 1/1996 |
| DE | 10025105 | 11/2001 |
| DE | 10151897 | 5/2003 |
| DE | 60012654 | 1/2005 |
| DE | 102005024179 | 11/2006 |
| EP | 1482311 | 12/2004 |
| EP | 1742010 | 1/2007 |
| WO | WO 2005033616 A1 * | 4/2005 |

* cited by examiner

*Primary Examiner* — Thomas H Tarcza
*Assistant Examiner* — Timothy A Brainard
(74) *Attorney, Agent, or Firm* — Robert W. Becker; Robert Becker & Associates

(57) ABSTRACT

A method and apparatus for defending against airborne assault ammunition. The assault ammunition is located with at least one position-locating device. The flight path of the assault ammunition is iteratively calculated using the determined ballistic coefficient of the assault ammunition. A firing control solution is determined for firing a fragmentation-type defense ammunition, which is fired with a large-caliber weapon, especially one having a caliber of at least 76 mm. A fuse of the defense ammunition is set after the firing and/or the defense ammunition is remotely detonated, and after the firing the defense ammunition is ignited or remotely ignited at an ignition time point $T_Z$. Alternatively, the ignition of the defense ammunition is initiated by a proximity igniter disposed in the defense ammunition.

22 Claims, 10 Drawing Sheets

METHOD AND APPARATUS FOR DEFENDING AGAINST AIRBORNE AMMUNITION

The invention relates to a method and an apparatus for defending or protecting against airborne assault ammunition. Airborne ammunition can represent, in particular, rockets as well as artillery and mortar shells (so-called RAM threats) or cruise missiles, aircraft and parachute objects, etc.

Methods are known where it is attempted to defend against airborne assault ammunition by firing defense ammunition having a fragmentation effect, fragmentation-type defense ammunition, in the direction of the previously located assault ammunition in order to combat the latter prior to its striking. Upon ignition of the defense ammunition, it disintegrates in particular the shell into a plurality of fragments that are additionally accelerated by the explosion. The spreading-out of the fragments is generally effected in a conical manner. If the assault ammunition strikes a fragment, it can be effectively combated under the assumption that the fragment has a sufficient size and a sufficient velocity in order to penetrate through the shell of the assault ammunition.

One such method, together with the radar equipment required for location, is described, for example, in DE 44 26 014 B4, DE 100 24 320 C2, EP1 518 087 B1, and DE 600 12 654 T2. Generally, fragmentation grenades are used as defense ammunition that are fired with a mortar. Ammunition having a fragmentation effect is described, for example, in DE 100 25 105 B4 and DE 101 51 897 A1. Position-locating devices for locating and following the assault ammunition, as well as for determining the flight path parameters of the assault ammunition, include short range radar, long range radar and optical sensors.

With the known methods, the objects that are to be defended against include primarily aircraft and apparatus close to the firing weapon. In this connection, close means a range of a few 100 m to a maximum of 500 m. The methods cannot be used for long distances going beyond this range. The reason for this is, among others, that the typical fragmentation grenade mortars used in the methods are only in a position to fire grenades having a firing velocity of a few 100 m/s. Thus, they can only be effective in the short range, since as the distance increases the velocity, and hence the energy, of the defense ammunition, which influence the energy of the fragments and which thus are necessary for a successful combating of the assault ammunition, greatly decrease.

The drawback of the known methods is thus that they cannot be used, or can be used only under very great effort, for defending against spatially spread-apart objects. For example, in order to defend a camp having a surface area of several square kilometers, a very large number of mortars must be put in place. Furthermore, with the known methods the defense ammunition that is used is effective only against certain assault ammunition, for example against anti-tank ammunition or against missiles, so that it does not provide protection against all assault ammunition.

Additionally, combating at close range is disadvantageous since then the danger exists that due to the combating itself, for example by fragments, damage can be caused to the objects that are to be protected. Furthermore, where the combating is not successful, a problem can occur that the time for a further attempt to combat is too short.

Another drawback of the known methods is that the fragmentation grenades have to have their fuses set prior to firing, i.e. the ignition time point is fixed prior to the firing and is imparted to the fragmentation grenade. The drawback of this is that, among others, due to the tolerances of the weapon, the propellant charge and the ammunition, a dispersion or deviation of the shot development time, which includes the time from closing the contact to the ignition of the ignition round or—with howitzers—until the shell leaves the muzzle, or of the ballistic dispersion is present, so that the fixed time point is to a large degree of certainty not the optimum time point for the ignition, since for example the defense ammunition at the time point of the ignition can be at a great distance from the assault ammunition. Again, tolerable results can be achieved only at close range, since when combating at a great distance, imprecisions, for example an error with regard to angle, lead to distinctly greater absolute deviations of the distance between assault ammunition and defense ammunition with regard to the ignition time point.

Also known is a configuration according to which the defense ammunition has a proximity igniter. The drawback of this, however, is that the setting of the correct trigger distance is critical. Furthermore, the assault ammunition can be very small, whereas the determined probable halt or delay space can be large due to the imprecisions of the sensor mechanisms and the dispersions, so that there is a high probability for failure of the proximity ignition. In addition, the active sensors mechanisms, such as an active radar, or the passive sensor mechanisms, such as infrared sensors, of the proximity igniter can be destroyed by the enemy, thus preventing ignition.

EP 1 742 010 A1 describes a non-lethal projectile having a programmable and/or settable igniter. The non-lethal ammunition can, in this connection, act among others by electromagnetic pulses, dyes, chemical irritants, fog or the like. All applications have in common that in particular no person should be harmed by the projectile. For this reason, a settable igniter is used, so that the non-lethal characteristic is not eliminated by the presence of projectile fragments.

DE 10 2005 024 179 A1, without providing any concrete applications, describes a method and apparatus for the setting of the fuse and/or for the correction of the ignition time point of a projectile. In this connection, the velocity of a projectile is measured after the firing. By means of the measurement the muzzle velocity is deduced, which is subsequently used for setting and/or correcting the ignition regulation time. A drawback of the method is in particular that further parameters that have an influence upon the ignition are not taken into consideration.

The object of the invention is to provide a method that can be effectively utilized for defending against airborne assault ammunition, as well as an apparatus for carrying out the method.

The method of the invention realizes the object with the features of claims 1 and 14, and the apparatus realizes the object with the features of claims 25 and 31. Advantageous further developments are the subject matter of the dependent claims.

It is a basic concept of the invention, after the location of an assault ammunition by means of at least one position-locating device, to determine the flight path of the assault ammunition. The more rapidly and precisely the flight path is determined, the more likely is a successful combating of the assault ammunition. The position-locating device, which includes at least one sensor (e.g. radar, actively and/or passively optoelectronically), should at a sufficient number of time points deliver coordinates and/or velocity of the assault ammunition, so that in particular via the determination of the ballistic coefficient c of the assault ammunition, the determination of the flight path is possible. The position-locating device is preferably georeferenced relative to the weapon.

Pursuant to one preferred embodiment, the position-locating device acquires the coordinates of the assault ammunition at specific discrete time points. From that, by differential formation the velocity of the assault ammunition can be determined, e.g. by dividing the velocity difference of the assault ammunition at two or more time points by the respectively passed time. The reduction of the velocity of the assault ammunition is a measure of its specific air resistance. From this specific air resistance, the ballistic coefficient c of the assault ammunition can be determined. Thus, it is possible to establish and solve the movement differential equations of the external ballistics of the assault ammunition. The result of this is the path of the assault ammunition as well as its striking point and location of firing.

Furthermore, in particular by means of a firing control computer, which can be disposed within a firing control location, a first firing control solution is determined for the firing of a defense ammunition, in particular an explosive projectile. Pursuant to this firing control solution, the defense ammunition is then fired by a large-caliber weapon. In this connection, the weapon has a caliber of at least 76 mm, preferably 120 mm or 155 mm. Such large-caliber weapons have a long range and a high achievable muzzle velocity of the defense ammunition, so that also at long range a combating of the assault ammunition can be achieved. The weapon used preferably has a high precision, in particular with regard to orientation.

The use of large calibers in contrast to the use of small calibers is furthermore advantageous for the reason that with small calibers the fragments derive their energy primarily from the velocity in trajectory, since due to the volume generally only a self-destruction charge can be built into a small caliber defense ammunition. As the distance increases, however, the velocity and energy of the defense ammunition greatly decreases. In contrast, with large calibers, an HE charge can be used, from which the fragments primarily derive their energy, so that this energy is independent of the flight range. Thus, even when defending larger objects, the defense ammunition is equally effective at close range and at long range, even against objects that are the hardest to attack. The combating of the assault ammunition should be effected at the latest at a distance of at least 800 m. However, a combating can also take place at significantly greater distances, for example at a distance of 3000 m, whereby at greater distances the likelihood of combating is reduced.

Pursuant to a first inventive embodiment, after the firing the defense ammunition will ignite or will be directly remotely ignited at a time point $T_Z$. Pursuant to a second inventive embodiment, the defense ammunition has only a proximity igniter that initiates the ignition of the defense ammunition when the assault ammunition lies in the effective range of the fragmentation-type defense ammunition.

Pursuant to the first inventive embodiment, the exact time point $T_Z$, especially at long range, is critical for the effectiveness of the combating, since already small deviations can, due to the high velocities and great distances, lead to large deviations between the predicted and the actual ignition location. For this reason, a defense ammunition is used that can have the fuse set after the firing and/or can remotely be ignited.

The defense ammunition can be provided with a receiving unit for receiving signals transmitted from a transmission unit, which is in particular connected to the firing control computer. In the event that the ignition of the defense ammunition is remotely controlled, in particular is wirelessly controlled, the determined time point $T_Z$ is used to ignite the defense ammunition at this time point. The receiving unit in this case receives remote control signals that via an in particular programmable ignition control unit leads to the ignition. Since, however, also the transmission of the transmission unit to the receiving unit requires a not exactly forecastable time, pursuant to a preferred embodiment, at a sufficient time prior to the ignition, setting signals, which contain the determined ignition time point $T_Z$, are transmitted to the receiving unit of the defense ammunition. The ignition control unit then ignites the defensive ammunition at the prescribed ignition time point, whereby with this embodiment a direct remote ignition is dispensed with. An increased reliability can be achieved if the receipt of the ignition time point $T_Z$ by the defense ammunition is acknowledged, for example at the firing control location, so that the correct receipt of the correct ignition time point $T_Z$ is ensured.

The determination of the ignition time point $T_Z$ is advantageously effected after the firing of the defense ammunition. It is in particular thus possible to take into account the further flight path progress of the assault ammunition. Furthermore, the movement of the defense ammunition can also be taken into account during the determination of the optimum ignition time point $T_Z$. For this reason, it is advantageous if the velocity $v_M$ of the defense ammunition, and the direction at a particular time point $T_Z$, be determined by means of at least one measurement device. It is therewith possible to form the reference for the spatial coordinate system of the ballistic calculations.

Pursuant to one embodiment, the velocity $v_M$ can be the muzzle velocity $v_O$, whereby in so doing the measurement can in particular include a coil, which is in particular disposed in the region of the muzzle opening of the weapon tube of the weapon. A coil for the measurement of muzzle velocity of a projectile is in principle described, for example, in EP 1 482 311 A1.

Pursuant to another embodiment the time point $T_M$ represents a time point in which the defense ammunition has already left the weapon. In this connection, the measuring device can in particular include a radar device. In order with this embodiment not to lose necessary time, the measuring device can have a directional capability, and can already be directed in the direction of the firing device at the time point of firing the defense ammunition. This can be achieved, for example, by means of a coupling between the weapon and the measuring device.

The determined velocity $V_M$, and the direction at the time point $T_M$ can be taken into account during the determination of the time point $T_Z$ of the ignition of the defense ammunition. Thus, the actual, time dependent flight path of the defense ammunition can be more precisely determined, thus achieving a greater probability of a successful combating. For this reason, a measuring device having a high precision should be utilized. In particular, a measuring device is utilized that has a standard deviation for the velocity determination of less than 0.5 m/s. Furthermore, the signal transmission times should also be kept short, whereby preferably components capable of real times should be utilized.

The determination of the ignition time point $T_z$ can be effected in such a way that the time point is determined at which a high, preferably the greatest, probability of a successful combating is present, and which in particular is derived from the product of the strike or hitting probability, which indicates whether a fragment hits the assault ammunition, and the probability of destruction, which indicates whether this fragment is in a position to destroy the shell of the assault ammunition. This combating probability is thus a function of various parameters. The greater the number of parameters that are taken into consideration during the determination of the ignition time point $T_Z$, the greater is the predictability.

The measurements and determinations of the measuring device and of the position-locating device can involve errors, for example imprecisions or inaccuracies can occur during the time measurement, the determination of the velocity, during the angle determination, and during the distance measurements. If these tolerances are known, they should be taken into account, since in a manner similar to ballistic dispersions, in other words, for example, deviations of azimuth and elevation of the weapon, as well as the firing development time, have an influence upon the probable location of halt of the assault ammunition and of the defense ammunition.

The type of assault ammunition, especially the hardness thereof, can also have an influence upon the optimum ignition time point $T_Z$. The military hardness of an assault ammunition essentially depends upon its wall thickness. In particular, there is a positive correlation between caliber and wall thickness, i.e. larger calibers generally also have a greater wall thickness and are thus militarily harder. To this extent, with a greater hardness of the assault ammunition, the ignition time point should possibility be effected late, so that although the striking probability is less, the destruction possibility is greater due to the greater kinetic energy, in order to thus achieve a high probability of combating.

In addition, the type of defense ammunition, in particular its properties such as fragmentation matrix, which include the spatial distribution of the fragments in accordance with number and size, fragment cone build-up time and imprecisions of the fuse-setting time, i.e. the dispersion of the time of the actual ignition ignited by the ignition control unit with a set ignition time point, are also of significance. Furthermore, the firing development time of the defense ammunition, as well as the ballistic dispersion, influence the ignition time point $T_Z$.

The determination of the time point $T_Z$ should be effected as rapidly as possible, since the time between the firing and the ignition of the defense ammunition is short. The flight time at a combating distance of, for example, 1000 m is with typical projectile velocities only in the order of magnitude of 1 s, and in this time span the velocity $v_M$ of the defense ammunition should be measured, a new firing control solution and from that the ignition time point $T_Z$ are to be calculated, and the data are to be transmitted to the igniter. Therefore, rapid algorithms are needed for calculating the firing control solution. For this reason, an analytical method should be relied upon.

There is also the aspect of the data transmission between various system components, for example between the position-locating devices, firing control computer, measuring device, transmission and receiving units, and ignition control unit. Thus, in addition to a real time-capable operating system of the firing control computer, and real time-capable bus systems, each individual component should be designed for a rapid transmission of the data.

Pursuant to an advantageous embodiment, the defense ammunition is additionally provided with a proximity igniter. In this connection, it is advantageous for the case in which the determined ignition time point is truly too late, that there exists a certain chance for igniting the defense ammunition in advance by means of the proximity igniter.

Pursuant to the second inventive embodiment, as an igniter the defense ammunition has only a proximity igniter, which initiates the ignition when the defense ammunition is at an in particular settable distance relative to the assault ammunition. This is sufficient for an effective combating in those situations in which the dispersions of the system are slight to the extent that with a high probability the assault ammunition passes into the effective range of the fragmentation-type defense ammunition.

With both embodiments, to determine the flight path the ballistic coefficient of the assault ammunition, which is positively ascertainable from the relationship of the cross-sectional surface to the mass of the assault ammunition, can first be determined. With the aid thereof, the movement equations of the external ballistic of the assault ammunition can be established and analytically or numerically solved. By a forward calculation, the location of striking of the assault ammunition and the data for the determination of the firing control solution for combating the assault ammunition can thus be determined. Furthermore, the firing location of the assault ammunition can be determined by a reverse calculation.

A basic idea of the method for determining the ballistic coefficient and the flight path is that the air resistance, which retards the assault ammunition during the flight, is determined by the decrease of its kinetic energy. In this connection, this air resistance force, which is related to mass, can be determined from the difference of two kinetic energies that are related to mass, relative to the distance that has in fact been traveled.

The kinetic energy of the assault ammunition at a location of the flight path can be calculated from its velocity, whereby the velocity can in turn be determined from two radar location measurements (location in time). In this connection, the air resistance is represented by the ballistic coefficient, which is essentially a function of the projectile velocity, the projectile geometry and atmospheric conditions. With the knowledge of the ballistic coefficient, the movement equations for the assault ammunition can be solved numerically, and hence the flight path can be calculated proceeding from a location determined from two radar measurements. If terrain information exists, the geographical coordinates (length, width, height) of the firing point of the assault ammunition or the strike point with the defense ammunition can be determined by comparison of the calculated fight path with the terrain profile in a suitable reference system.

Thus, only four measurements, in particular mere distance measurements along an axis, preferably along the radar beam, are sufficient for the determination of the flight path, since on the one had for the calculation of the kinetic energy at a location of the flight path, two radar site measurements are required as previously set forth. In order to be able to determine the necessary ballistic coefficient c, it is on the other hand necessary to know the kinetic energy at a further location, so that two further measurements are required. Due to the fact that the position-locating device need collect only four measurement points, the method is adequately rapid.

One advantage of the presented method is the high precision of the calculated flight path, and hence of the prognosticated striking point or firing location of the assault ammunition. On the other hand, from the formula performance, with the aid of the error propagation, the method makes it possible to be able to define the necessary sensor precisions in order to equip early warning and flight defense systems with certain characteristics and to check their suitability. This can be achieved by the special form of the movement differential equations, of the separation of the air resistance coefficient into fixed and variable components, and by use of a specific reference system for the velocity-dependent component thereof. Thus, the method makes it possible to determine only the component that is actually dependent upon the assault ammunition, as a result of which a classification is also possible.

The classification of the located assault ammunition can be carried out by means of the ballistic coefficient. The basis for this is that the ballistic coefficient for a type of assault ammunition always lies in a constant narrow range. Upon recognition of this value range, which can be obtained, for example, by analysis of firing tables, an assault ammunition can be associated to a specific coefficient.

The first determined firing control solution, according to which the defense ammunition is fired, is preferably of such a size and scope that the compensation of tolerances of the location and measuring devices that are used and that contain sensors, and of the weapon and defense ammunition that is used and contains effectors, is possible by means of the ignition time point $T_Z$ determined after the firing.

By means of the determination of the probability of a successful combating, it is also possible to establish the ammunition requirement, i.e. the type and number of defense ammunition as well the required distribution. Where the use is for a defense of a camp, it is additionally possible during the planning how the weapons should be distributed in order to obtain an effective defense against different assault scenarios.

The defense ammunition can be fired in conformity with the determined ammunition requirement as long as the successful combating of the assault ammunition is not recognized. In this connection, either one weapon can fire a number of defense ammunitions, or a plurality of weapons can be utilized. In conjunction with this, various confidence levels of a likely to expect successful combating can be indicated. At a high confidence level, a high likelihood of a successful combating is also aspired to. For this reason, the number or type of defense ammunition can be adapted in conformity with the desired confidence level in order thus to influence the probability of a successful combating. With the determination of the ammunition requirement, it is additionally advantageous to take into consideration the parameters already mentioned above for the determination of the ignition time point $T_Z$, in other words preferably the taking into consideration of measurement inaccuracies of the measuring device, in particular during the determination of time point, velocity, azimuth, elevation, and/or distance, measurement inaccuracies of the locating device, in particular during the determination of time point, velocity, azimuth, elevation, and/or distance, type of assault ammunition, in particular hardness thereof, type of defense ammunition, in particular its characteristics such as fragmentation matrix, fragment cone build-up time, imprecisions of the fuse-setting time, firing development time of the defense ammunition, and ballistic dispersion.

As an advantageous reliability aspect, prior to the firing, the defense ammunition can be preset to a time point $T_{vor}$ that in time is prior to the time point $T_B$ that is predicted by the firing time solution determined prior to the firing, and In which the defense ammunition strikes the ground If there is no ignition. This ensures that for example in case the transmission of the ignition time point for the firing control signals is not correctly transmitted, the defense ammunition ignites prior to striking the ground, so that no person or device is injured or damaged on the ground. However, so that the ignition does not take place too soon, in particular not prior to the time point in which the signals are received by the defense ammunition, the time point $T_{vor}$ can, in time, be after the time point $T_A$ that is determined by the ignition time point $T_Z$ of the defense ammunition predicted by the firing control solution determined prior to the firing.

In order to achieve a high precision during the determination of the flight path parameters of the assault ammunition, at low expenditure, it is possible after the first location of the assault ammunition by the position-locating device to transmit the location data to a second location device, in particular a target tracking radar unit that carries out the measurement of the values necessary for the determination of the flight path. In this connection, a surveillance radar can be utilized as the first position-locating device.

Since the flight path of the assault ammunition is known, a warning, for example an acoustical warning can be delivered for the region of the point of striking on the ground determined by the determined flight path of the assault ammunition, so that in this region precautionary measures can be undertaken in order to prepare for the event that combating of the assault ammunition is not successful.

It is furthermore advantageous if from the determined flight path of the first located assault ammunition the location of firing thereof is deduced, so that preferably with the same weapon that combats the assault ammunition, it is also possible to combat the attacker, who can often be at a great distance away.

Possible exemplary embodiments of the invention will be explained in detail with the aid of FIGS. 1 to 10, in which:

FIG. 1 shows a camp having four weapons for defending against airborne assault ammunition in a schematic illustration, One embodiment of the present invention will be described subsequently with the aid of the drawings, in which:

FIG. 1 shows a camp having four weapons for defending against airborne assault ammunition in a schematic illustration.

Figure 7:
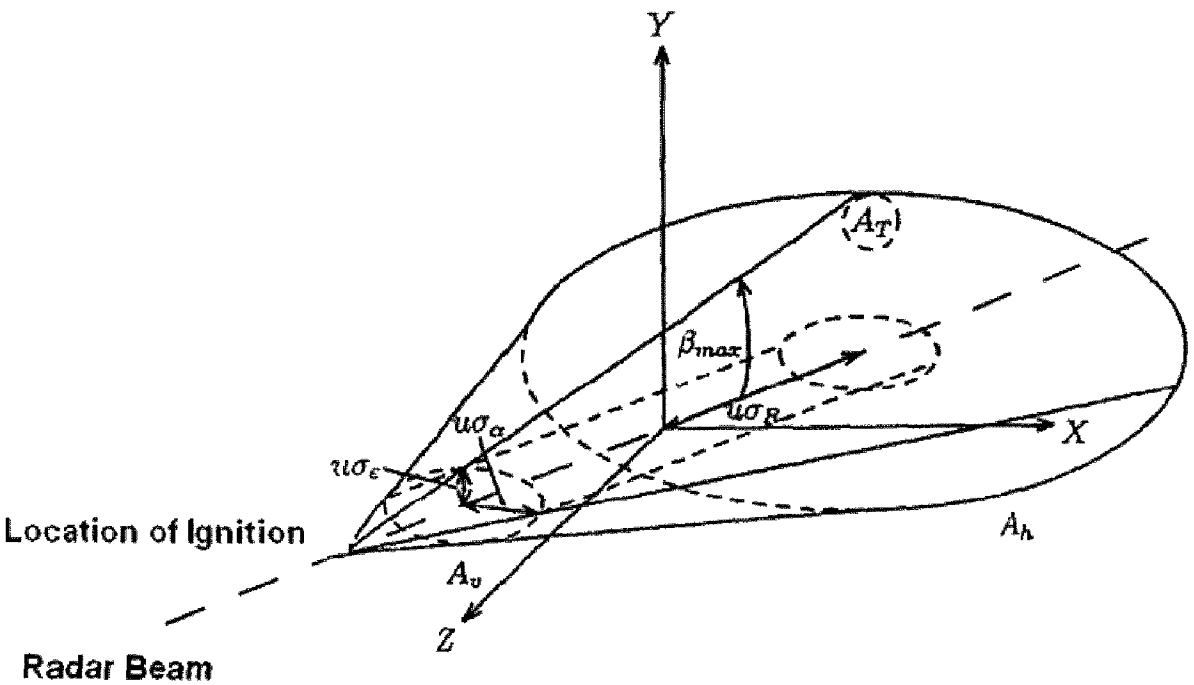
Figure 8:
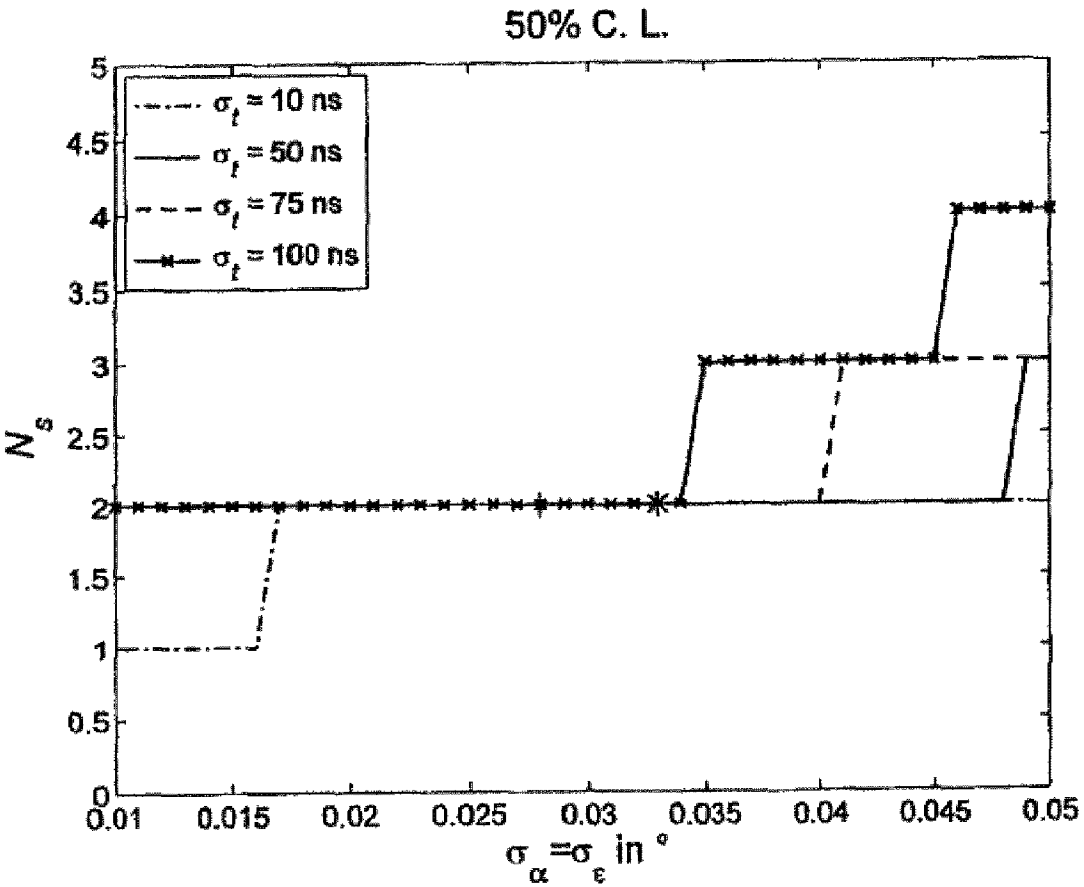
Figure 9:
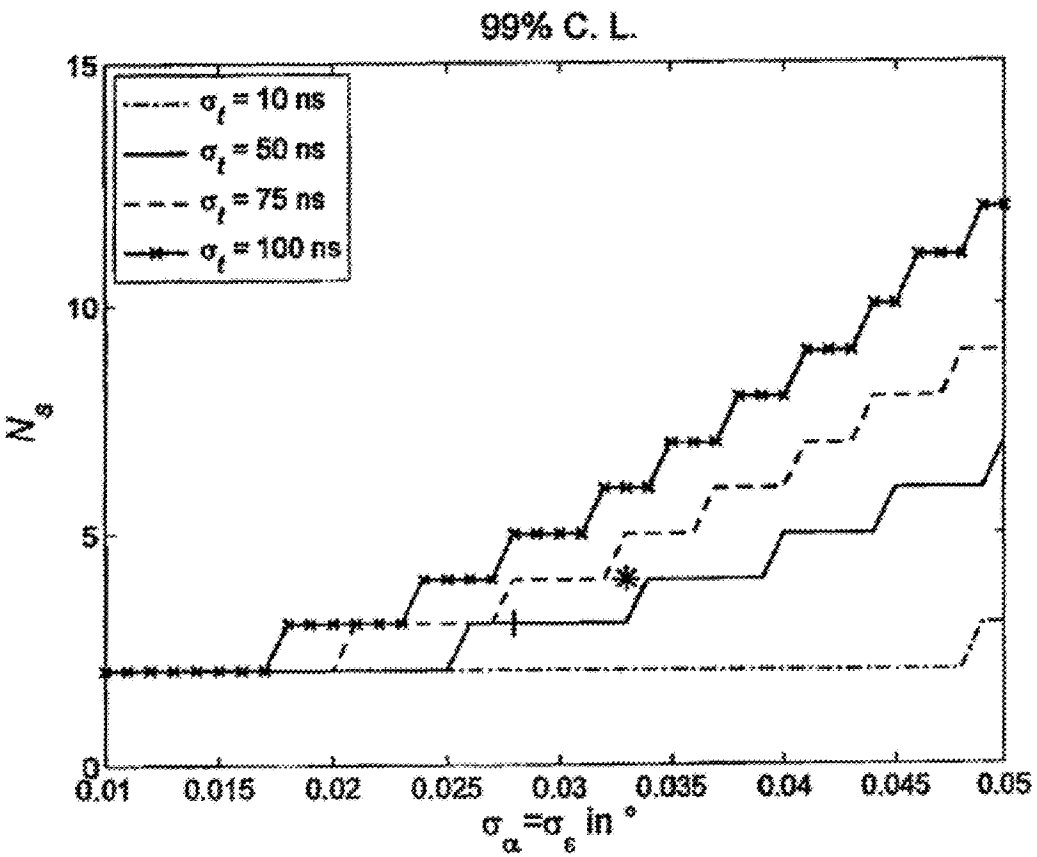
Figure 10:
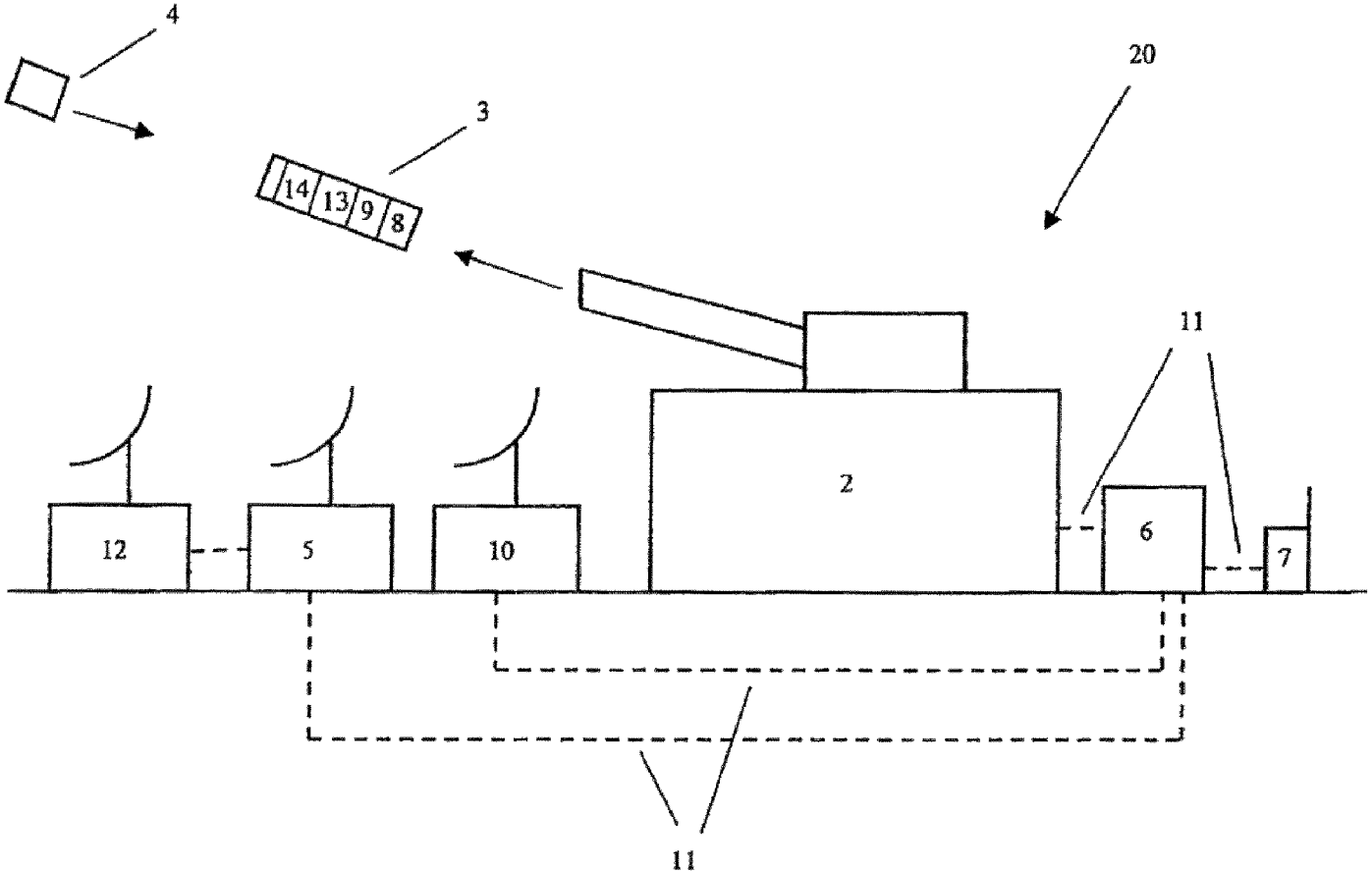

FIG. 7 shows a coordinate system for the geometry of the fragment cone with an elliptical cylinder, FIG. 8 is a graph for the ammunition requirement for the successful combating at a confidence level of 50%, FIG. 9 is a draft for the ammunition requirement for the successful combating at a confidence level of 99%, and FIG. 10 shows an apparatus for defending against assault ammunition in a schematic illustration.

Figure 1:
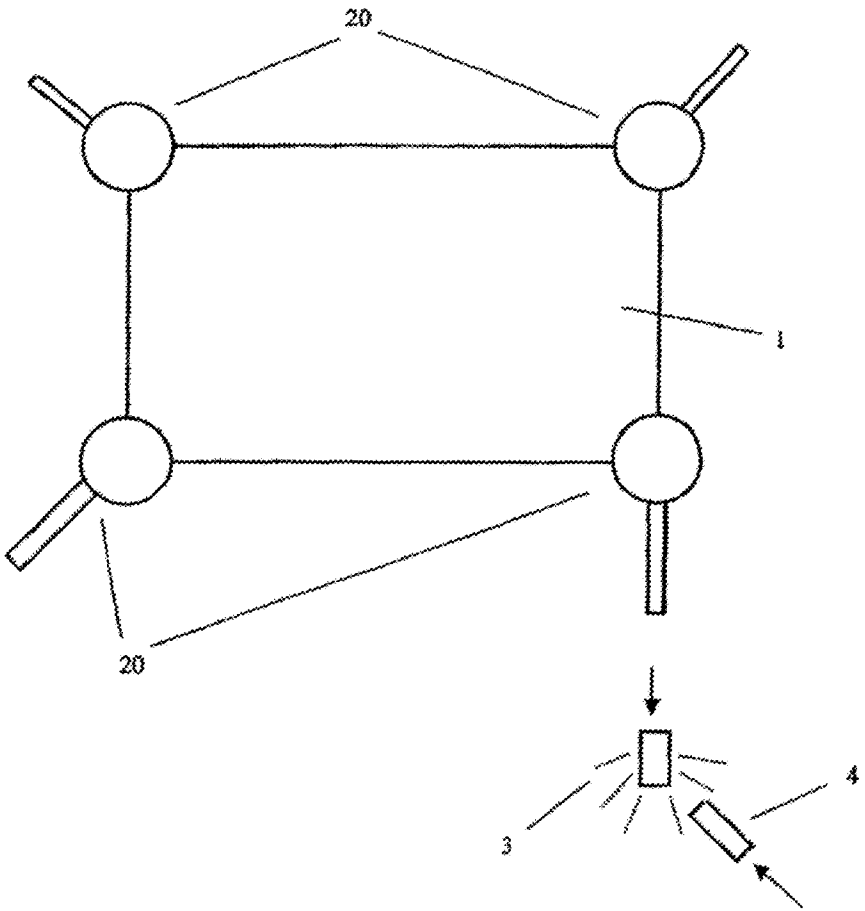

The method and the apparatus are utilized for the protection or defense of a spatially spread out camp 1 having a rectangular surface area pursuant to FIG. 1. In each corner of the camp is an apparatus 20, which is schematically illustrated in FIG. 10. It includes a weapon 2, which can fire the fragmentation defense ammunition 3, a first position-locating device 12, a second position-locating device 5, a measurement device 10, a signal transmission unit 7, and a firing control computer 6. The weapon 2, the position-locating device 5, the measurement device 10, and the signal transmission unit 7 are connected to the firing control computer 6 via data lines 11. For optimum combat, the position-locating device 5 and the weapon 2 are distributed spatially close to one another. The defense ammunition 3 contains an ignition control unit 9, a signal receiving unit 8, an igniter 13, and an explosive charge 14. Due to the arrangement of the region of the corners of the camp 1, it is possible during the course of overcoming or combating assault ammunition 4 with the defense ammunition 3 to prevent firing over the camp 1. A further advantage with the use of a number of weapons 2 is the increase in the certainty of having a frontal resistance with as small an angle of impact as possible, which is advantageous due to the high difference in velocities between the assault ammunition 4 and fragments.

Figure 2:
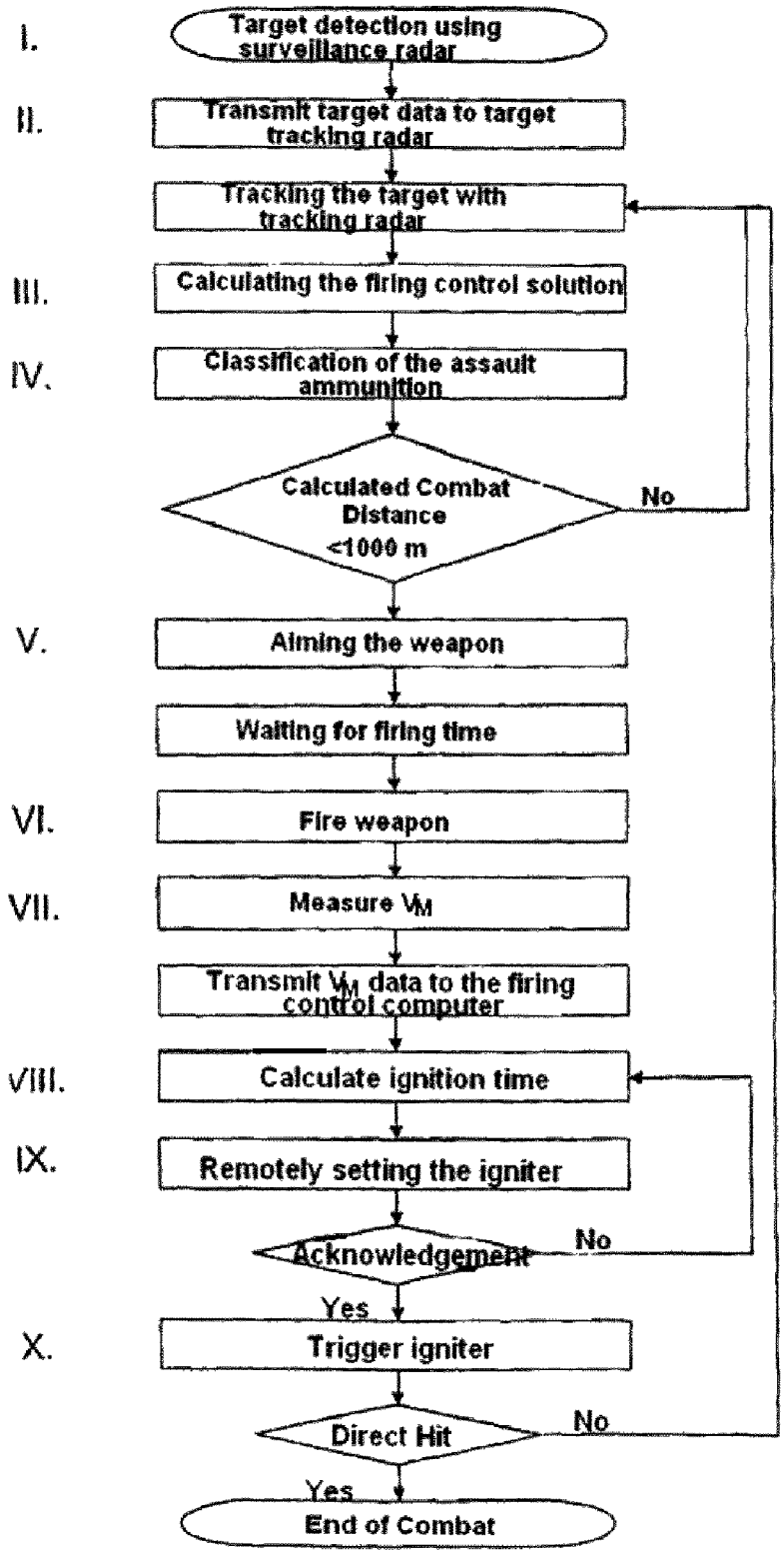
FIG. 2 is a chart showing the operating sequence of the method.

The combat sequence pursuant to FIG. 2 is as follows:

I. Locating the assault ammunition 4 with a first position-locating device 12;

II. Transmitting the target data to a second position-locating device 5 and target tracking;

III. Calculation of the firing control solution with the firing control computer 6;

IV. Classification of the assault ammunition 4;

V. Aiming the weapon;

VI. Firing the defense ammunition 3 in order to carry out a combat at the desired distance;

VII. Measuring the defense ammunition velocity $v_M$ and transmitting the data to the firing control computer 6;

VIII. Calculating a corrected firing control solution and determining the ignition time point $T_Z$;

IX. Remotely transmitting the ignition time point $T_Z$ to the ignition control unit 9 (alternatively: directly remotely triggering the igniter or detonator 13);

X. Igniting or detonating the explosive charge 14, forming the fragment cone.

In general, it should be noted that the sequence of the aforementioned steps need not necessarily correspond to the listed sequence. For example, the classification of the assault ammunition 4 can also be carried out after the aiming of the weapon 2.

Regarding I.

Location of the assault ammunition 4 with a first position-locating device 12:

A known surveillance radar is used as the first position-locating device 12.

An example of the assault ammunition 4 includes a mortar shell (82 mm) of cast iron with a mass of 3.31 kg and a wall thickness of about 9 mm to 10 mm that was fired with a firing velocity of 211 m/s at a distance of 3040 m at an angle of 45°.

Regarding II.

Transmission of the target data to a second position-locating device 5 and target tracking:

After the location by means of the first position-locating device 12, the target data is transmitted to a second position-locating device 5, which is configured as target tracking radar, for the further tracking of the target. This second position-locating device 5 includes a radar system that includes a radar sensor having the designation MWRL-SWK. This is a Russian air space monitoring radar for airports with a radar range of 1 km to 250 km, standard deviation in azimuth and elevation of 0.033°, standard deviation for the distance measurement of 10 m, standard deviation for the time determination of 66.7 ns, and an angular velocity of 18°/s to 90°/s.

For the purpose of determining the error budget of the second position-locating device 5, the bases of the location measurements are provided here in order with the aid of a pulse radar, azimuth a, elevation $\epsilon$, as well as the time t to be able to calculate the radar location of the assault ammunition 4. Alternatively, for a radar device having rotating antennae, the radar angular velocity is used for the calculation of three radar sites.

Figure 3:
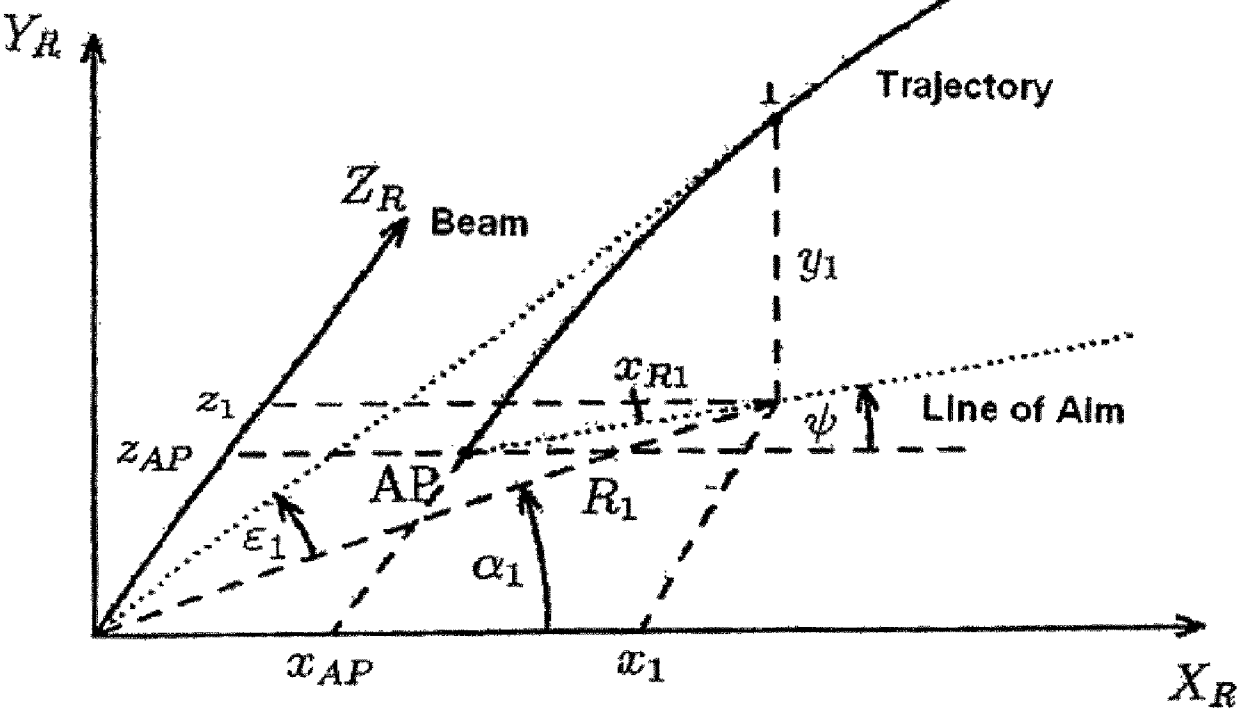
FIG. 3 is a 3D coordinate system of the radar location geometry.
Figure 4:
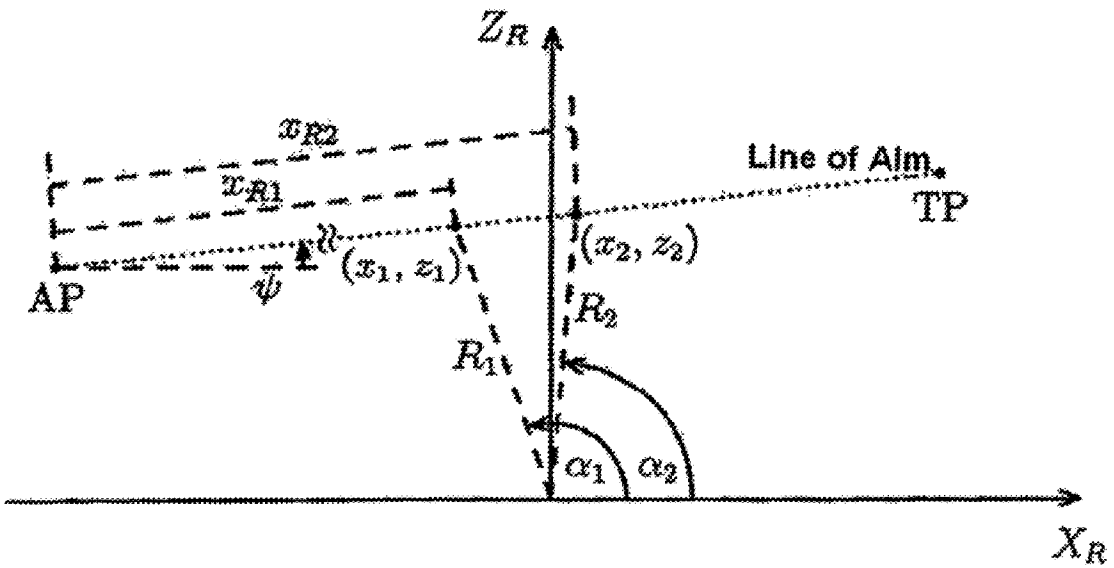
FIG. 4 is a 2D projection of the radar location geometry of FIG. 3.

The coordinates of the location of the assault ammunition 4 (i=1 . . . 4) are determined with the aid of the location trigonometry pursuant to FIGS. 3 and 4 (equations 1a and 1b):

$$x_i = \frac{z_{AP} - x_{AP}\tan\psi}{\tan\alpha_i - \tan\psi}$$

$$z_i = x_i\tan\alpha_i$$

Where $\alpha_i$ is the azimuth angle of the assault ammunition 4 from the radar, $x_{AP}$ and $z_{AP}$ are coordinates of the point of firing, and $\Psi$ is the azimuth of the line of aim relative to the abscissa of the reference system.

The y coordinate of a radar site i is determined from the distance of the assault ammunition 4 from the radar R and the elevation of the radar beam $\epsilon$ (Equations 2a and 2b):

$$y_i = R_i \tan \epsilon_i$$

$$R_i = \sqrt{x_i^2 + z_i^2}$$

The horizontal distance of the radar site from the point of firing (Equation 3)

$$x_{R_i} = \sqrt{(x_i - x_{AP})^2 + (z_i - z_{AP})^2}$$

is utilized in order to calculate the flight time of the assault ammunition 4 corresponding to the radar site and the height coordinates of the radar site $y_1$ from the solution of the set of differential equations. With this it is then possible to determine the desired angle of elevation of the radar (Equation 4):

$$\varepsilon_i = \arctan\frac{y_i}{\sqrt{x_i^2 + z_i^2}},\ i = 1 \ldots 4$$

In the case of a radar unit having rotating antennae, the first azimuth angle of the location of the assault ammunition 4, and hence its coordinates, are prescribed by Equation 1, so that the three following radar sites result from the angular radar velocity $\omega$ (Equation 5):

$$t_i = t_1 + \frac{2\pi}{\omega}(i-1),\ i = 1 \ldots 4$$

As well as the distance point of firing radar site (equation 6a and 6b):

$$x_i = (x_{R_i} - x_{R_{i-1}})\cos\psi + x_{i-1}$$

$$z_i = (x_{R_i} - x_{R_{i-1}})\sin\psi + z_{i-1}$$

where i=2 . . . 4.

The desired azimuth angles are calculated as follows (Equation 7):

$$\alpha_i = \arctan\frac{z_i}{x_i},\ i = 2 \ldots 4$$

The elevation angles $\epsilon_1$ result from equation 4.

Regarding III.

Calculation of the firing control solution with the firing control computer 6:

In order to determine a first firing control solution, the movement equations of the assault ammunition 4 must first be solved.

The movement equations of the projectile 4 that is to be combated are derived from the center-of-mass principle, whereby the projectile 4 is seen as the point mass, and for the sake of simplification exclusively the air resistance and the force of gravity act thereupon as external forces. They are applied in the travel-dependent form (Equations 8a to 8d):

$$v'_x = \frac{dv_x}{dx} = -c_2(Ma)v(x)K_y$$

$$p' = \frac{dp}{dx} = -\frac{g}{v_x(x)^2}$$

$$y' = \frac{dy}{dx} = p(x)$$

$$t' = \frac{dt}{dx} = \frac{1}{v_x(x)}$$

where:
v: Velocity
$v_x$: Velocity components in the x direction
$c_2$(Ma): Air resistance coefficient as a function of the Mach number and the ballistic coefficients
$K_y$: Factor for correcting the velocity on the basis of height.
y: Travel in the y direction
x: Travel in the x direction
p: tan θ
g: Acceleration due to gravity
t: Time
θ: Firing or Aiming Angle The coefficient $c_2$(Ma) is composed of a projectile-dependent component, an empirical velocity-dependent component, and an atmospheric component: $c_2(Ma)=f_1(c)*f_2(c_{MA})*f_3(c_a)$. The projectile-dependent component $f_1(c)$ contains the ballistic coefficient c=A/m. The velocity dependent component $f_2(c_{MA})$ is present as a reference function that is determined experimentally or is calculated pursuant to known processes and can be used for ballistic projectiles. The third component $f_3(c_a)$ depends upon atmospheric conditions (such as air pressure, temperature) and can, for example, be seen as a constant for short firing distances at low heights. If necessary, corrections for the standard values of temperature and air pressure can be added to this component.

The set of differential equations for describing the projectile movement is solved with conventional numeric processes. The targeted site of impact is determined by forward integration. The backward calculation yields the firing site. For this purpose, the air resistance coefficient $c_2$(Ma) is required as a starting parameter.

Figure 5:
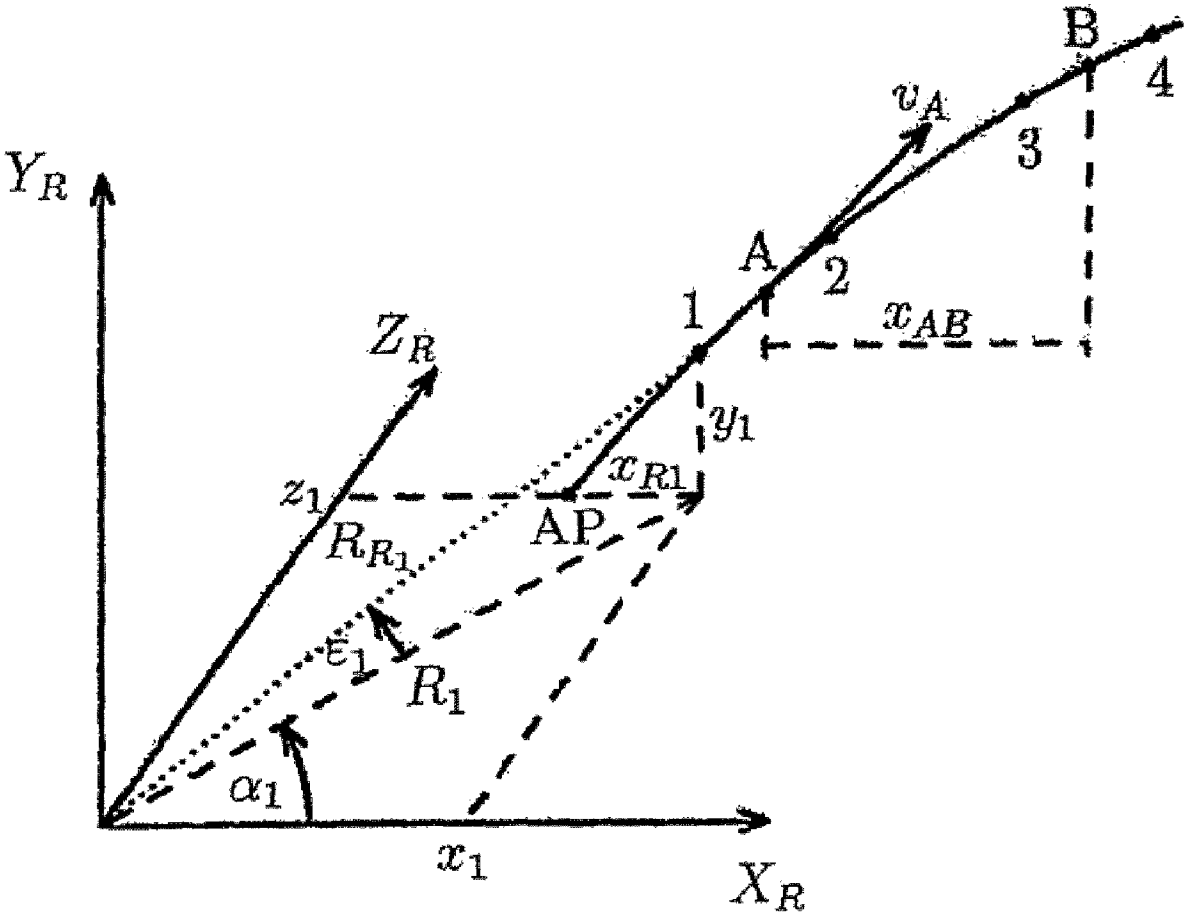
FIG. 5 shows a further coordinate system of the radar location geometry.

The for the time being unknown ballistic coefficient c of the projectile 4 is thus the decisive parameter in order, proceeding from a projectile site B determined from radar measurements, to calculate the further trajectory, and for y=0 the impact site, from iterative numerical solution of the equations 8a to 8d. The following method is used for the experimental determination of the air resistance in order to determine the ballistic coefficient c and hence the air resistance coefficient $c_2$(Ma):

The ballistic coefficient c can be determined from the air resistance force acting on the projectile 4, whereby this air resistance force results from the difference of the kinetic energy of the projectile 4 at the site A and B and the distance measured between these two sites (see FIG. 5). The kinetic energy in A and B can for this purpose be expressed by the projectile velocities.

In this connection critical is that the velocity-dependent component $f_2(c_{MA})$ is known from the reference function, and the component $f_3(c_a)$ is taken as a constant. Therefore, it is only necessary to determine the component of the air resistance coefficients $c_2$(Ma), which is actually a function of the projectile. This component is calculated as the ballistic coefficient c.

The determination of the air resistance coefficients $c_2$(Ma), from which the ballistic coefficient c can easily be calculated, results from the forces equilibrium with the known resistance function and the average deceleration force of the air resistance (Equation 9):

$$F_W = \frac{\rho}{2} c_W v^2 A = m a_W$$

Whereby $c_2$(Ma) is defined as follows (Equation 10):

$$c_2(Ma) = \frac{\rho}{2} \cdot \frac{c_W A}{m}$$

With this definition and Equation 9 as well as subsequent addition of the velocity correction $K_y$ already used in the set of equations 8 there results the determination equation for $c_2$(Ma) (Equation 11):

$$c_2(Ma) = \frac{a_W}{v_m^2 K_y}$$

For the deceleration $a_w$, and the average horizontal velocity $v_m$ there is applicable (Equations 12 and 13):

$$a_W = \frac{1}{2} \frac{v_{x_A}^2 - v_{x_B}^2}{x_{AB}}$$

$$v_m = \frac{v_{x_A} + v_{x_B}}{2}$$

By the following determination of the ballistic coefficient c=A/m from the air resistance coefficient $c_2$(Ma), which strictly applies only for the site of the measurement, $c_2$(Ma) can be adapted to changed velocities of the assault ammunition and changed atmospheric conditions, and hence more precise results can be achieved with the iterative solving of the set of equations 8. Furthermore, this enables the described classification of the assault ammunition.

The horizontal distance of the determined radar sites A and B results from the geometry (Equation 14):

$$x_{AB} = \sqrt{(x_B - x_A)^2 + (z_B - z_A)^2}$$

The velocities and the site coordinates in the x and z directions at the site A and B are calculated from two respective projectile locations determined with a pulse radar relative to the coordinate system of the radar Unit. Dictated by the special form of the movement differential equations, which result by the conversion of the time-dependent form of the movement differential equations into a location-dependent form, only the horizontal components of the velocity, and the horizontal distance between the determined radar sites A and B, are required. Due to the fact that the path of the assault ammunition is observed only in its projection on an axis (here: x axis), it is possible to dispense with a complete path tracking in all three axes. Thus, distance measurements are sufficient. As a result, a rapid determination of the parameters necessary for determining the flight path can be achieved.

The effect of measurement errors of the radar site measurements upon the error in range (width of the band 2*w* in the firing direction, which contains x % (such as 50%) of all released shots when the average impact point lies upon the center line of this band), the width dispersion (analogous to the error in range, although the band is disposed perpendicular to the direction of firing and horizontally) as well as the Circular Error Probability (CEP) of the point of impact, which is determined by the radius about the point of impact, in the circular area of which x % of all released shots N lie, are determined in order to be able to fix the error budget of the radar sensors of the position-locating device 5. All systematic measurement errors are remedied by adjustments of calibration, so that only the measurements of the azimuth a, the elevation c, as well as the time t are subject to random error influences. It is assumed that these are distributed in a normalized manner with the average value p=0, and that the respective measurement devices provide the standard deviations $\sigma_a$, $\sigma_E$, $\sigma_t$.

With a position-locating device 5 having rotational antennae, the angular velocity w thereof is also error-charged with the standard deviation c~ whereby the magnitude thereof results from the error of the time measurement.

With the ballistic coefficient c, proceeding from the centered projectile location B, the further trajectory and the point of impact can be determined by iterative numeric solution of the equations 8a to 8d. Therefore, the errors of the radar site measurements selfpropogate via the ballistic coefficient to the point of impact, and determine the sought dispersion.

To determine the error in range, the standard deviation o~ of the ballistic coefficient c is first calculated from the random errors of the azimuth, the elevation, and the time, whereby the time errors can be determined with the speed of light in vacuum from the range error of the radar unit 5. If the radar unit 5 has rotating antennae, the standard deviation of the angular velocity is derived from the time error. In conjunction therewith, the mathematical interrelationships of the Gaussian error propagation are utilized. Subsequently, with the onset of varying disruption parameters, by generating random numbers distributed in a normalized manner and numeric solving of the set of differential equations, the error in range of the point of impact can be determined. The width dispersion is calculated directly from the measurement errors of the time, of the azimuth, and of the underlying location geometry.

The Circular Error Probability (CEP) of the impact location is calculated from the error in length and the width dispersion of the point of impact. This is numerically calculated pursuant to a method set forth in the literature with the standard deviations in the x and z directions as well as the pertaining covariance cov(x,z) as starting parameters for the desired confidence level.

In the present embodiment, the assault ammunition 4 is to be combated at a distance of 1000 m at a target height of 500 m. This leads to a firing angle of about 26.6°. The location distance of the radar is also 1000 m.

Regarding IV.

Classification of the Assault Ammunition 4:

A classification of the located assault ammunition 4 is carried out with the aid of the ballistic coefficient c. The value ranges of the ballistic coefficient c of various possible assault ammunition 4 that are likely to be expected were previously derived by evaluating range tables. Thus, a type of assault ammunition 4 can be associated with each ballistic coefficient c. This association is carried out by the firing control computer 6.

The use of the determination of the type of assault ammunition 4 can be limited only in the rare cases where the value ranges of the coefficient c overlap. Independently thereof, however, the location precision of the radar sensor of the position-locating device 5 that is used has a significant effect upon the unambiguity of the result.

In each case, from the knowledge of the ballistic coefficient, important indications regarding the assault ammunition 4 that is to be combated are obtained. In the event that the assault ammunition 4 is known, it is possible, for example, to also determine the caliber and hardness thereof, for example from a table.

Regarding V.

Aiming of the Weapon 2:

An armored howitzer is used as the weapon 2. This self propelled artillery cannon is in a position to fire projectiles 3 having a caliber of 155 mm. After the weapon tube of the armored howitzer 2 is aimed, the weapon is on standby for firing time.

Regarding VI.

Firing of the Defense Ammunition 3 in Order to Carry Out a Combat at the Desired Distance:

By way of example, an HE explosive projectile (155 mm) is used as a defense ammunition 3, and is fired with the armored howitzer 2. In order to achieve a high, muzzle velocity, the greatest possible propellant charge is utilized. The fragment mass distributions and fragment velocities of the defense ammunition 3 are previously determined with explosion tests in an explosion receptacle. The fragment cone build-up time refers to the time during which the diameter of the fragment cone is the same as the radar CEP surface.

The fragmentation effect of explosive projectiles results from the disintegration of the projectile shell into thousands of fragments which are additionally accelerated by the explosion. The fragment mass distribution, which is determined within the framework of explosions, and the fragment velocities, are analyzed pursuant to a series of explosion tests. From these, the experimental fragment matrices that are known from the literature are determined, in which matrices the fragments are classified according to their fragment escape angle and their mass.

After initiation of the explosive charge 14 on the flight path, a fragment cone that is open in the direction of movement is formed, the opening angle of the cone being a function of the of the velocity of the defense ammunition 3, the initial velocity of the fragments, and the fragment escape angle. Since the fragment distribution was determined in an explosion receptacle under static conditions, the translatory velocity of the explosion projectile 3 to the time of initiation is to be superimposed vectorially and the dynamic splinter escape angle is to be determined. Based upon the air resistance, the velocity of the fragments decreases as the distance from the site of initiation increases.

The number of effective fragments depends upon whether the kinetic energy of the fragments is greater than the minimum energy needed to destroy the assault ammunition 4 at an assumed angle of impact. The fragments that fulfill this condition are effective. The minimum energy is derived from the energy that is necessary to penetrate the projectile wall of an RAM target, and to ignite the explosive charge. The tank formula according to de Marre, which is known from the literature, is used in order to estimate the penetration energy of assault ammunition 4.

For the described assault ammunition 4, an energy of, for example, 1200 J can be indicated as the minimum energy.

The energy needed to explode the explosives of the assault ammunition 4 is determined with the aid of the sensitivity to percussion of typical explosives. The striking of a fragment against an assault ammunition 4 is modeled as a plastic impact process, and the conversion of mechanical energy into internal energy that occurs in so doing ultimately corresponds to the energy available for the destruction of the assault ammunition 4.

Regarding VII.

Measurement of defense ammunition velocity $v_M$ and transmission of the data to the firing control computer 6:

The measurement of velocity $v_M$ can be effected via radar. By means of the determination, the muzzle velocity $v_O$ can be completed. By measuring the velocity $v_M$ via radar, the Doppler process or the pulse travel time process can be utilized.

In an alternative embodiment, a real time capable $v_o$—coil is integrated in the tube of the weapon 2 as a measurement device 10 that by means of induction provides the starting velocity of the defense ammunition 3 of the actual shot and the time point of the measurement. It also forms the reference for the spatial coordinate system of the ballistic calculations.

Regarding VIII

Calculation of a corrected firing control solution and determination of the ignition time point $T_Z$:

The determination of the ignition time point $T_z$ by means of the corrected firing control solution should be effected as rapidly as possible, since the time between the firing and the ignition of the assault ammunition 4 is short. To calculate the corrected firing control solution a method is used that analytically solves the differential equations of the external ballistics. In this connection, a mathematical function, namely Lerch's phi, is used. With a special approximation process, such as, for example, the Gaussian error quadratic method, the values of $k_1$ and $k_2$ from the equation $c_w=k_1*Ma\hat{}k_2$ can be derived from the official firing tables (measurement values). The value $c_w$ provides the relationship of the air resistance between a projectile and an infinitely wide flat plate as a function of the Mach number. Only with a correct $c_w$ value can the correct air resistance force, and thus the correct flight path, of a projectile be determined. By means of the approximation of this equation, the movement differential equations of the external ballistic for Mach numbers >1 (supersonic) can be analytically solved. In so doing a rapid calculation of firing control solutions can be achieved, since no numerical integration is necessary.

The method can additionally be combined with the method described in de 10 2005 023 731 A1. The method described there is used for determining the firing control solution in the presence of a relative movement between weapon and target. Such a relative movement is formed in the present context by the movement of the assault ammunition where the weapon does not move.

To determine the ignition time point $T_Z$ the parameters are taken into account that have an influence upon the optimum ignition time point. The ignition time point $T_Z$ should be the point in time at which the greatest likelihood of a successful combat is present. Due to the dispersions and tolerances, only a likely halt space of the assault and defense ammunitions, as well as a probable development of the fragmentation effect after the ignition, can be given.

Generally, the assault ammunition 4, and above all its cross-sectional area, are small. Due to the impreciseness in determining the location, the likely halt range of this target is in contrast large, and is geometrically described by an elliptical cylinder, i.e. by a cylinder having an elliptical surface area (FIG. 7). The location of ignition of the defense ammunition 3 resulting from the ignition time point is determined taking into consideration the following aspects:

- on the one hand, the distance to the target 4 should be as small as possible, since due to the air resistance as the distance from the location of ignition increases, the number of effective fragments decreases.
- on the other hand, should slightly miss the target 4, since the greatest number of fragments occur in the rim region of the fragment cone.

It is advantageous if from the two calculated ignition time points a weighted average is used, so that the likelihood of destruction is maximized. The weighting factors can be a function of the caliber and the type of assault ammunition that is determined by the location device, and can be determined by simulation or experiments.

The precise maintenance of the ignition time $T_Z$ is very significant, and its precision must lie in the millisecond range, since otherwise the ignition would take place too far in front or behind the target 4.

A decisive value is initially the dispersion ignition time itself, i.e. with what imprecision the igniter 13 ignites at a set ignition time point. An igniter 13 is used that has a dispersion or spreading of the setting time of less than 2 ms.

The determination of the ignition time point $T_Z$ is effected via a determination of the ignition distance. This will be explained with the aid of an ammunition requirement calculation. By means of the ammunition requirement calculation, it is possible to determine how many defense ammunitions 3 have to be fired in order for a predetermined confidence level to achieve an effective combat of the assault ammunition 4.

The ammunition requirement calculation is based on known statistical fundamentals and provides the amount of ammunition that is required on average in order to completely destroy the target. This depends upon the exponential destruction principles of the firing probability of a fragment $p_K$ and the number of effective fragments against the target surface $N_W$.

Figure 6:
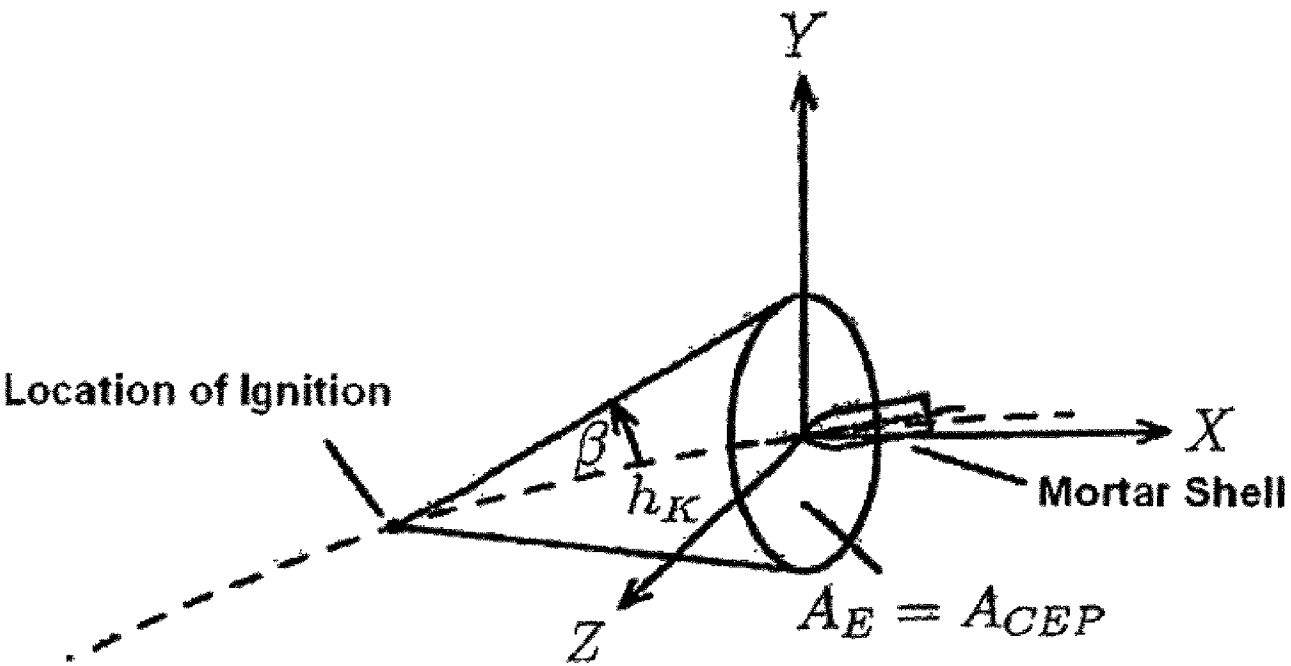
FIG. 6 shows a coordinate system for the geometry of the fragment cones.

For the calculation of the firing probability of $N_W$ effective fragments against the target surface, the essential assumption is made that, as schematically shown in FIG. 6, the surface area of the fragment cone $A_E$ should be exactly as great as the radar CEP surface $A_{CEP}$ in which the assault ammunition 4 is found with the determined probability (e.g. P=50%).

The firing probability $p_K$ of an individual fragment results from the multiplication of the impact probability $p_H$ with the destruction probability $P_{K|H}$. The impact probability $p_H$ indicates in the case of a frontal combat the likelihood on the one hand to strike the circular target surface and on the other hand to also strike the assault ammunition 4 in the longitudinal direction thereof. The destruction probability $p_{K|H}$ depends on the ratio of the energy of the defense ammunition 3 to the minimum energy for penetrating the shell of the assault ammunition 4 and decreases exponentially thereto.

Measurement errors of the sensors of the measurement and position-locating devices 5, 10 and 12 in azimuth, elevation and distance magnify the likely location of halt of the assault ammunition 4 that is to be combated and the radar CEP surface, so that the ammunition requirement increases with imprecise sensors. In addition, deviations or dispersions exist with the firing development, the muzzle velocity of the defense ammunition 3, and the ignition time for the initiation of the projectile or shell, as well as the subsequent development of the fragment cone. There is also the ballistic dispersion of the ammunition 3 and of the weapon 2. This has an effect upon the likelihood of impact and hence the requirement for ammunition. Therefore, within the framework of the desired ammunition requirement for a fixed confidence level, the error budget, which is the sum of all errors in the system that must not be exceeded, characterized for the entire system, is fixed.

In the first step of the practical performance, as a function of the selected radar unit 5 the surface perpendicular to the radar beam is calculated in which the assault ammunition 4 is present with the probability P. This surface should correspond to the surface area of the fragment cone $A_E$, so that as much as possible at least one fragment of all of the effective fragments can strike the target surface $A_T$. This target surface $A_T$ is disposed with the probability P somewhere in the $A_{CEP}$ and is thus a partial surface of $A_{CEP}$.

With the surface $A_E$ it is then possible to determine the ignition distance $h_K$, which corresponds to the fragment cone height, whereby for this purpose initially the opening angle of the fragment cone $\beta_{max}$ is to be estimated. This serves—with the path velocity of the defense ammunition 3 in the prognosticated location of combat-as the input value for the calculation of the fragment cone from the fragment distributions experimentally determined in the explosion receptacle. With the now determined fragment cone opening angle $\beta_{max}$, it is now possible to calculate an improved ignition distance and hence the fragment cone. By means of the ignition distance or interval, with the knowledge of the measured reference time $T_M$ the ignition time point $T_Z$ is determined.

The total number of the effective fragments, the opening angle, and the path velocity in the location of combat serve, together with the previously indicated data, as input parameters for the previously described ballistic probability calculation in order to calculate the ammunition requirement $N_S$.

This ammunition requirement applies pursuant to FIG. 7 strictly speaking only for the surface area of the elliptical cylinder that faces the location of ignition. If the assault ammunition 4 actually halts, for example, in the rear region of the elliptical cylinder, the fragment density is significantly less and due to the longer flight path the fragment velocity is reduced. As a result, the number of effective fragments per unit of surface area is reduced, and the ammunition requirement is increased. With a more precise distance measurement, which can be carried out by a further, non-illustrated sensor, the length of the elliptical cylinder can be significantly reduced, so that the ammunition requirement in the entire elliptical cylinder is of the order of magnitude of the surface area that is disposed the closest to the ignition location.

Regarding IX.

Remote transmission of the ignition time point $T_Z$ to the ignition control unit 9 (alternatively: direct remote triggering of the igniter 13):

The determined ignition time point $T_Z$ is transmitted via the signal transmission unit 7, which is configured as a radio or wireless unit, as coded setting signals to the signal receiving unit 8, which is configured as a radio or wireless unit. The signal receiving unit 8 conveys the signals further to the ignition control unit 9, in which the new ignition time point is stored. Furthermore, by means of the two wireless units 7 and 8, the correct receipt of the ignition time point $T_Z$ is acknowledged to the firing control computer. If no acknowledgment is effected, the ignition time point is recalculated and is transmitted to the defense ammunition 3.

Pursuant to another embodiment, by means of coded remote control signals, at the determined ignition time point $T_Z$ the igniter 13 is remotely triggered immediately after the correct receipt. With a suitable selection of the carrier frequency (e.g. 520 kHz), the entire code can be sent within 100 μs, so that the transmission time point $T_Ü$ practically coincides with the ignition time point. By the use of a direct remote triggering, the determination of the optimum ignition time point can advantageously be delayed as long as possible, so that a more exact determination of the flight paths is possible.

An increased reliability can be achieved by coding the setting signals or remote control signals. The code is evaluated by the ignition control unit for the determination of the correct receipt of the remote control signals. Only after verifying the code, which must coincide with the code known to the ignition control unit, is the setting determination converted or the ignition directly initiated.

Pursuant to a further, non-illustrated embodiment, the defense ammunition is additionally provided with a proximity igniter, which initiates the ignition when the defense ammunition 3 is disposed at a regulatable distance relative to the assault ammunition 4. In this connection, it is advantageous in the case where the determined ignition time point is really too late, for a certain opportunity to exist to initiate the defense ammunition in advance by means of the proximity igniter.

Pursuant to a non-illustrated embodiment, the defense ammunition is merely provided with a proximity igniter as an igniter, but no wireless unit 8. The proximity igniter triggers the ignition when the defense ammunition 3 is disposed at a regulatable distance relative to the assault ammunition 4, e.g. at a distance of 1 m. Thus, with this embodiment, the method steps VII to IX from FIG. 2 are not carried out.

Regarding X.

Ignition of the explosive charge 14, formation of the fragment cone:

After the ignition of the explosive charge 14, the fragment cone is formed. In the event that the assault ammunition 4 is not successfully combated, a further defense ammunition 3 is fired with a new firing control solution. Pursuant to one advantageous embodiment, however, a plurality of defense ammunitions 3 are fired directly one after the other from one or more weapons 2 pursuant to the ammunition requirement that is determined, without waiting for acknowledgement of a successful combating.

The following results of ammunition requirement calculations show that with the radar system MWRL-SWK selected in the exemplary embodiment, it is possible to realize firing numbers $N_S<10$ with 155 mm explosive projectiles or shells as defense ammunition. The 155 mm shell is very suitable for combating an 82 mm mortar shell as an assault ammunition. In this connection, among others, the large number of effective fragments $N_{figes}=7857$, in conjunction with a large fragment cone opening angle $\beta_{max}=79.5°$, is responsible. FIG. 8, for various dispersions, shows a graph for the ammunition requirement for the successful combating at a confidence level (C.L.) of 50%, and FIG. 9, for various dispersions, shows a graph for the successful combating at a confidence level of 99%. In this connection, with both FIGS. 8 and 9, in each case the standard deviation of azimuth and elevation of the radar unit is plotted on the abscissa, and are taken to be the same. Plotted on the ordinate are the required, integral firing numbers for prescribed values of C.L. Noteworthy is that even at a destruction probability of 99%, the ammunition requirement for 155 mm shells, with the assumptions that are made, is a maximum of four firings and hence clearly in the single digit range.

The invention claimed is:

1. A method of defending against airborne assault ammunition, including the steps of:

locating the assault ammunition using at least one position-locating device;

determining the ballistic coefficient of the assault ammunition via an ascertainment of the air resistance force of the assault ammunition;

iteratively calculating the flight path of the assault ammunition utilizing the ballistic coefficient;

determining a firing control solution for firing of fragmentation-type defense ammunition;

firing said defense ammunition with a weapon having a caliber of at least 76 mm, wherein after said firing step, said defense ammunition is adapted to have a fuse thereof set and/or to be remotely detonated;

after said firing step, igniting or remotely igniting said defense ammunition at an ignition time point $T_Z$; and determining the air resistance force of the assault ammunition relative to mass from the difference between two kinetic enemies of the assault ammunition at two locations, and the distance between these two locations.

2. A method according to claim 1, which includes the further step of determining a velocity of said defense ammunition at a certain time point by means of at least one measurement device, whereby said measurement device is capable of being directed and, at the time point of said firing step of said defense ammunition, is directed in a direction of the firing direction.

3. A method according to claim 1, which, for obtaining said ignition time point, includes the step of determining the time point at which the greatest probability of a successful combating of the assault ammunition exists, wherein said probability is obtained from the product of the strike probability, which indicates whether a fragment of said defense ammunition strikes the assault ammunition, and the destruction probability, which indicates whether such fragment is in a position to destroy a shell of the assault ammunition.

4. A method according to claim 3, which includes the step, during the step of determining said ignition time point, of taking into account at least one parameter selected from the group consisting of:

a) measurement inaccuracies of said measuring device, during a determination of time point, velocity, azimuth, elevation and/or distance;

b) measurement inaccuracies of said at least one position-locating device, during a determination of time point, velocity, azimuth, elevation and/or distance;

c) type of assault ammunition;

d) type of defense ammunition, e) firing development time of said defense ammunition; and f) ballistic dispersion.

5. A method according to claim 3, which includes the step of determining said ignition time point $T_Z$ by means of an analytical method.

6. A method according to claim 1, wherein said ballistic coefficient of said assault ammunition is also determined for a determination of the type of assault ammunition.

7. A method according to claim 1, which for the determination of a kinetic energy includes the steps of obtaining two measurement points via said at least one position-locating device, and from said measurement points determining the velocity of the assault ammunition.

8. A method according to claim 1, which includes the further step of determining a likely ammunition requirement for defense ammunition.

9. A method according to claim 8, wherein said defense ammunition is fired pursuant to the determined ammunition requirement as long as there is no recognition of a successful combating of the assault ammunition.

10. A method according to claim 1, which, during the determination of the ammunition requirement, includes the step of taking into consideration at least one parameter selected from the group consisting of:

a) measurement inaccuracies of said measuring device, during a determination of time point, velocity, azimuth, elevation and/or distance;

b) measurement inaccuracies of said at least one position-locating device during a determination of time point, velocity, azimuth, elevation and/or distance;

c) type of assault ammunition;

d) type of defense ammunition;

e) firing development time of said defense ammunition; and f) ballistic dispersion.

11. A method according to claim 1, wherein prior to said firing step a fuse of said defense ammunition is preset to a time point that in terms of time is prior to a time point that is predicted by the firing control solution determined prior to said firing step, and at which time said defense ammunition strikes the ground if it is not ignited, and wherein said time point is, in terms of time, subsequent to a time point that is ascertained by said ignition time point of said defense ammunition predicted by the firing control solution determined prior to said firing.

12. A method according to claim 1, which includes the step of delivering a warning for the region of a point of striking the ground determined by the determined flight path of the assault ammunition.

13. A method according to claim 1, which includes the steps of solving movement equations of the external ballistic for said step of calculating the flight path of the assault ammunition.

14. A method of defending against airborne assault ammunition, including the steps of:

locating the assault ammunition using at least one position-locating device;

determining the ballistic coefficient of the assault ammunition via an ascertainment of the air resistance force of the assault ammunition;

iteratively calculating the flight path of the assault ammunition utilizing said ballistic coefficient;

determining a firing control solution for firing of a fragmentation-type defense ammunition;

firing said defense ammunition with a weapon having a caliber of at least 76 mm;

initiating ignition of said defense ammunition by means of a proximity igniter disposed in said defense ammunition; and determining the air resistance force of the assault ammunition relative to mass from the difference between two kinetic enemies of the assault ammunition at two locations, and the distance between these two locations.

15. A method according to claim 14, wherein said ballistic coefficient of said assault ammunition is also determined for a determination of the type of assault ammunition.

16. A method according to claim 14, which for the determination of a kinetic energy includes the steps of obtaining two measurement points via said at least one position-locating device, and from said measurement points determining the velocity of the assault ammunition.

17. A method according to claim 14, which includes the further step of determining a likely ammunition requirement for defense ammunition.

18. A method according to claim 17, wherein said defense ammunition is fired pursuant to the determined ammunition requirement as long as there is no recognition of a successful combating of the assault ammunition.

19. A method according to claim 14, which, during the determination of the ammunition requirement, includes the step of taking into consideration at least one parameter selected from the group consisting of:

a) measurement inaccuracies of said measuring device, during a determination of time point, velocity, azimuth, elevation and/or distance;

b) measurement inaccuracies of said at least one position-locating device during a determination of time point, velocity, azimuth, elevation and/or distance;

c) type of assault ammunition;

d) type of defense ammunition;

e) firing development time of said defense ammunition; and f) ballistic dispersion.

20. A method according to claim 14, wherein prior to said firing step a fuse of said defense ammunition is preset to a time point that in terms of time is prior to a time point that is predicted by the firing control solution determined prior to said firing step, and at which time said defense ammunition strikes the ground if it is not ignited, and wherein said time point is, in terms of time, subsequent to a time point that is ascertained by said ignition time point of said defense ammunition predicted by the firing control solution determined prior to said firing.

21. A method according to claim 14, which includes the step of delivering a warning for the region of a point of striking the ground determined by the determined flight path of the assault ammunition.

22. A method according to claim 14, which includes the steps of solving movement equations of the external ballistic for said step of calculating the flight path of the assault ammunition.

* * * * *